United States Patent [19]

Alderete

[11] Patent Number: 4,848,309

[45] Date of Patent: Jul. 18, 1989

[54] MASONRY PUNCH

[76] Inventor: Johnny Alderete, 8855 NW. 28 Dr., Coral Springs, Fla. 33065

[21] Appl. No.: 223,646

[22] Filed: Jul. 25, 1988

[51] Int. Cl.[4] ..... B28D 1/26

[52] U.S. Cl. ..... 125/40; 30/361; 30/367

[58] Field of Search ..... 125/40, 41, 42, 43; 30/361, 366, 367; 83/667, 669, 682, 684, 686, 399

[56] References Cited

U.S. PATENT DOCUMENTS

| | | | |
|---|---|---|---|
| 944,523 | 12/1909 | Thompson . | |
| 2,130,232 | 9/1938 | Goodenough . | |
| 2,577,535 | 12/1951 | MacKenzie . | |
| 3,381,376 | 5/1968 | Ames | 30/361 |
| 4,730,395 | 3/1988 | Blessing, Sr. | 30/366 |

*Primary Examiner*—Frederick R. Schmidt
*Assistant Examiner*—Maurina Rachuba
*Attorney, Agent, or Firm*—Gifford, Groh, Sheridan, Sprinkle and Dolgorukov, P.C.

[57] ABSTRACT

A punch for forming a rectangular opening in cinder block. The punch includes a housing having a wall with a toothed edge and which is generally rectangular in crosssectional shape. A tube is secured to the housing and extends perpendicularly outwardly from the toothed edge so that the axis of tube is positioned within the interior of the area circumscribed by the toothed edge of the housing. A rod having a piercing point at one end is slidably mounted within the tube so that the piercing point is contained within the housing while the other end of the rod protrudes outwardly from the free end of the tube. In use, the housing and piercing point are both positioned against the cinder block. The rod and free end of the tube are then struck by a hammer in order to form the rectangular opening in the cinder block.

4 Claims, 2 Drawing Sheets

MASONRY PUNCH

BACKGROUND OF THE INVENTION

I. Field of the Invention

The invention relates generally to punches and, more particularly, to a punch for making a rectangular opening in cinder block.

II. Description of the Prior Art

Many homes, and particularly those in southern climates, are constructed from masonry materials and, in particular, from cinder block. Such a concentration is not only relatively inexpensive, but is also quite durable.

One disadvantage of cinder block homes, however, is that it is difficult to install the electric wiring in the walls. In particular, in order to install light switches, electrical outlets and the like, it is necessary to form a rectangular opening in the cinder block which thereafter receives the electrical junction box for the switch, electrical outlet or the like.

It has been the previously known practice to form these rectangular openings in the cinder block by using conventional punches which are used to form the hole into the cinder block by repeatedly breaking small pieces of cinder block from the wall. It is difficult, however, to accurately punch a hole of the required size into the cinder block so that the hole is frequently either too small or too large.

When the hole is too small, conventional punches can be used to enlarge the hole in the cinder block, but this process is time consuming and, therefore, increases the labor cost. Conversely, when the hole is too large, the hole must be partially filled by masonry materials which is not only time consuming, but also expensive in both material and labor costs.

Therefore, even if the hole is formed of the proper size in the cinder block, the process of forming the hole is time consuming and physically tiring for the electrician as well as costly for the owner.

SUMMARY OF THE PRESENT INVENTION

The present invention provides a tool which overcomes all of the above mentioned disadvantages of the previously known devices.

In brief, the present invention provides a punch for forming rectangular holes adapted to receive electrical junction boxes for electrical switches, electrical outlets and the like in cinder block as well as other masonry materials. Furthermore, as will become hereinafter apparent, the tool of the present invention is not only simple and easy to use, but also enables rectangular holes to be rapidly formed as desired in the cinder block.

More specifically, the punch of the present invention comprises a housing having a wall with a toothed edge which is adapted to abut against the cinder block. The housing is generally rectangular in crossectional shape and conforms in size to the size of the electrical junction box to be mounted into the wall.

A tube is secured to the housing so that the tube extends perpendicularly away from the toothed edge of the housing. Furthermore, this tube is attached to the housing so that the axis of the tube is aligned with substantially the center of the housing.

A rod having a piercing point on one end is slidably mounted within the tube. The piercing point is positioned within the housing adjacent the toothed edge while the other or free end of the rod protrudes outwardly from the free end of the tube. In practice, the toothed edge of the housing as well as the piercing point are positioned against the cinder block in which the rectangular opening is desired. With the tool positioned in this fashion, the rod protrudes outwardly from the free end of the tube by a relatively small distance, for example ½ an inch.

The free end of the rod is then struck by a hammer which initiates the hole in the cinder block. The further forward motion of the mallet causes the hammer to strike the free end of the tube and forces the toothed edge of the housing into and through the cinder block thus forming the rectangular opening in the desired fashion. Repeated blows of the hammer may be necessary in order to completely form the rectangular opening in the cinder block.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
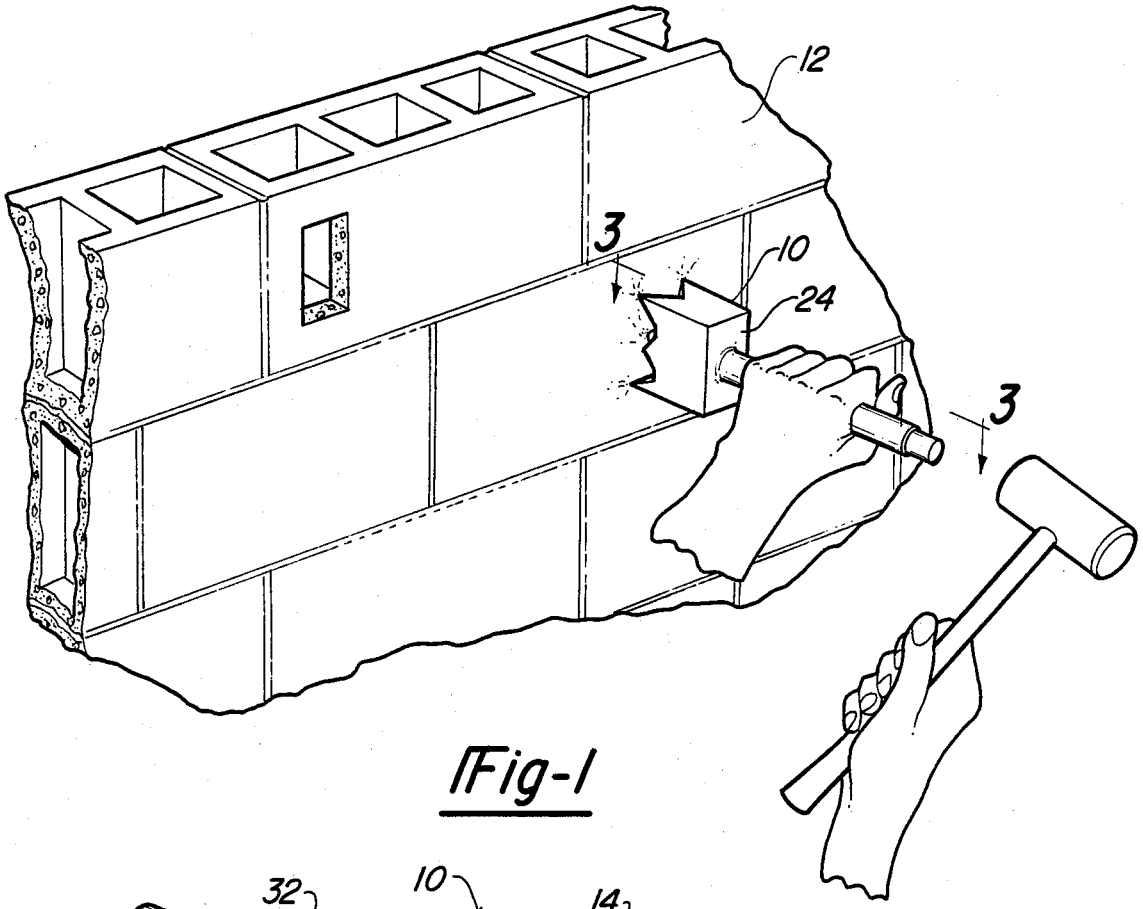
FIG. 1 is an elevational view illustrating the operation of a preferred embodiment of the present invention.
Figure 2:
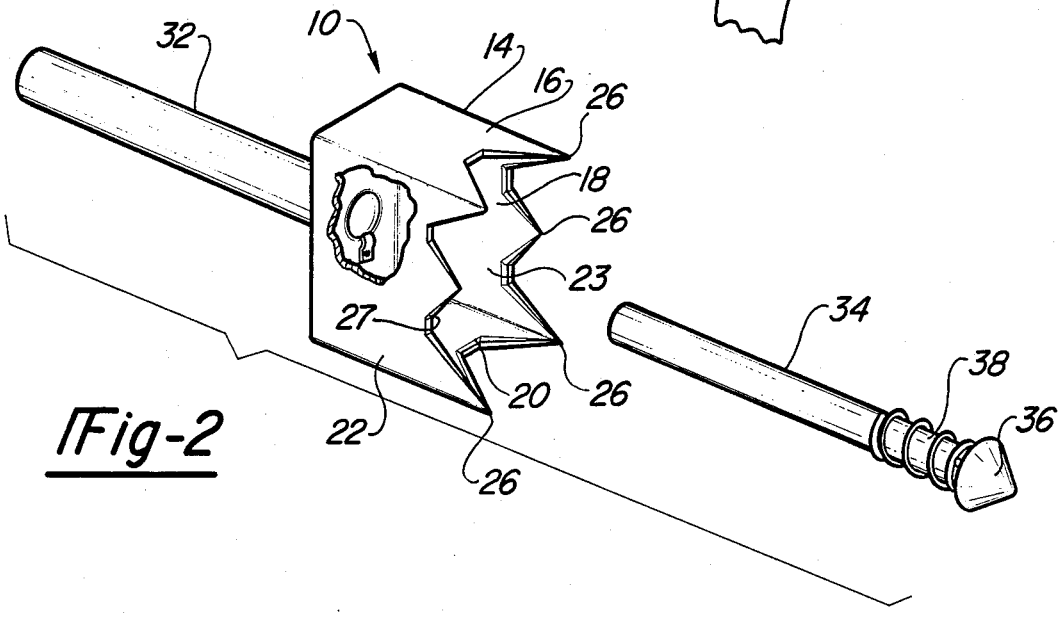
FIG. 2 is an exploded view of the preferred embodiment of the present invention.
Figure 3:
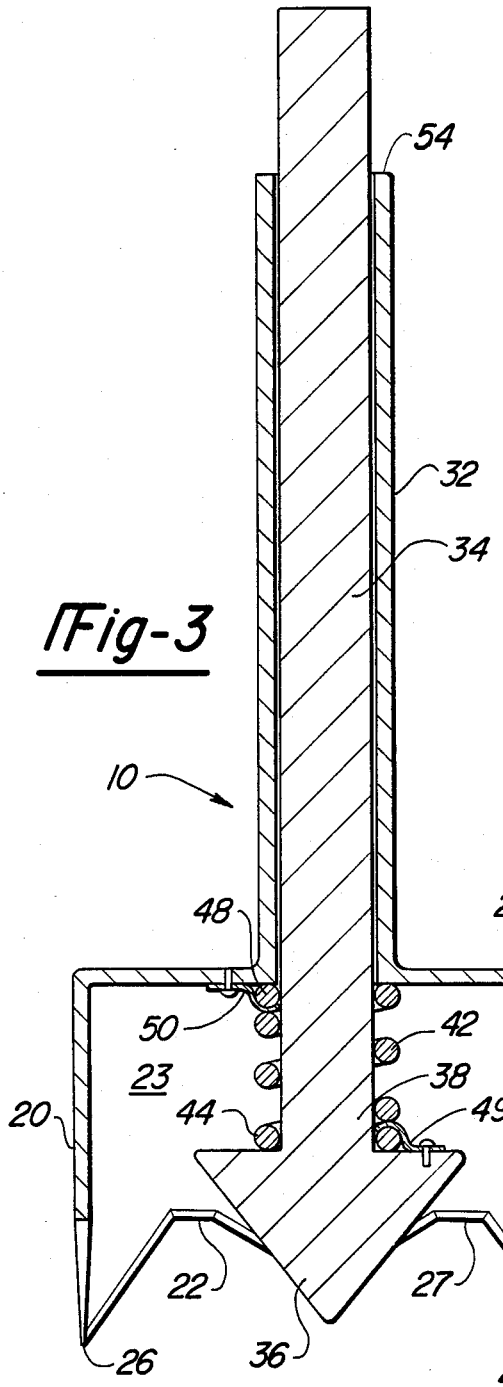
FIG. 3 is a longitudinal sectional view of the preferred embodiment of the present invention.

With reference now to FIGS. 1–3, a preferred embodiment of the tool 10 of the present invention is thereshown for forming rectangular openings in a wall 12 constructed of a masonry material, such as cinder block. As will become hereinafter apparent, the rectangular opening is dimensioned to receive an electrical junction box for a light switch, an electrical outlet or the like.

Referring now particularly to FIGS. 2 and 3, the tool 10 of the present invention comprises a housing 14 which is generally rectangular in crossectional shape. The housing 14 thus comprises four side walls 16, 18, 20 and 22 which, together, form a housing interior 23. A rear wall 24 (FIG. 3) extends across the rear edges of the walls 16–22.

Figure 4:
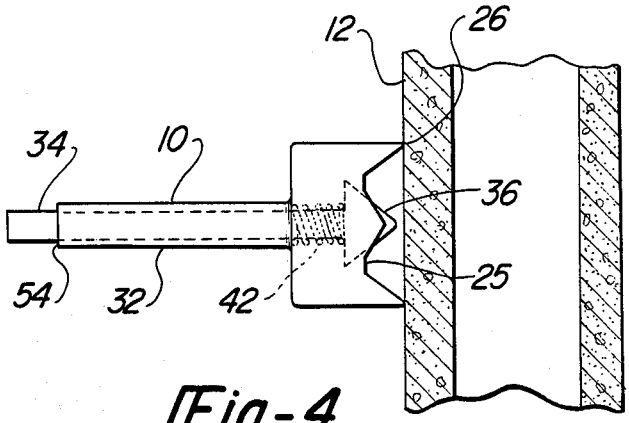
FIGS. 4–6 are side diagrammatic views illustrating the operation of the preferred embodiment of the present invention.

A plurality of piercing teeth 26 protrude outwardly from a front edge 27 of the walls 16–22 opposite from the rear wall 24. One piercing tooth 26 is preferably provided at each corner of the housing 14 while another piercing tooth 26 is disposed along one or more edges of the housing 14 in between the tooth 26 at the housing corner. As best shown in FIG. 4, the intermediate teeth 26 are slightly shorter than the corner teeth 26.

The teeth 26 are preferably ground on a forty-five degree angle on their inside surface. This gives the teeth 26 a better piercing edge for punching holes in the wall 12.

Referring still to FIGS. 2 and 3, an elongated tube 32 is secured to the rear wall 24 of the housing 14 so that the axis of the tube 32 intersects the area circumscribed by the tooth edge 27 of the housing 14 and also so that the axis of the tube 32 is substantially coaxial with the center of the housing 14.

The tool 10 of the present invention further comprises an elongated rod 34 having a conical punch or piercing point 36 secured to one end 38. The rod 34 is axially slidably received within the tube 32 so that the punch 36 is contained within the interior 23 of the housing 14.

As best shown in FIG. 3, a helical spring 42 is positioned around the rod 34 so that one end 44 of the spring 42 abuts against the circular base of the conical piercing point 36. The other end 48 of the spring 42 abuts against the interior of the housing back wall 24.

The spring 42 urges the conical point 36 outwardly from the toothed edge 27 of the housing 14. However, in order to hold the rod 34 and housing 14 together, retaining clips 49 and 50 respectively secure the ends 44 and 48 of the spring 42 to the rod 34 and housing 14.

Figure 5:
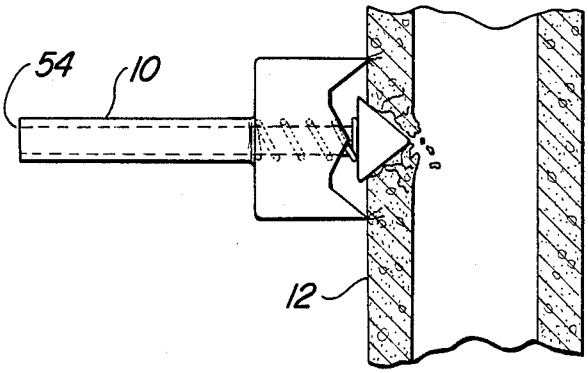
Figure 6:
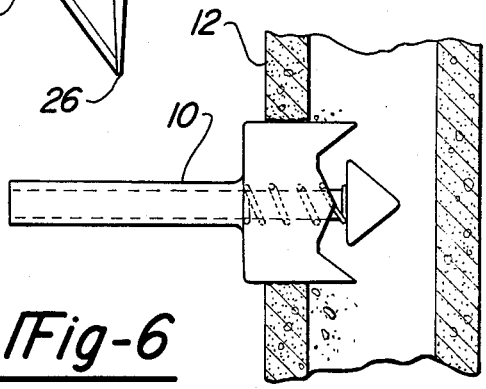

With reference now to FIGS. 4–6, in practice the piercing teeth 26 on the toothed edge 27 of the housing are positioned against the cinder block wall 12 in which the rectangular opening is desired and also so that the tool is aligned with a hollow of the cinder block wall 12. The spring 42 simultaneously urges the piercing point 36 into abutment with the wall 12 at substantially the center of the desired rectangular opening. The spring 42 also cushions the tool against a shattering effect when the tool is struck. In addition, the rod 34 is dimensioned so that, with the housing 14 and piercing point 36 in abutment with the wall 12 as described above, a free end 52 of the rod 34 protrudes outwardly from a free end 54 of the tube 32 by a small amount, for example one half an inch.

The end 52 of the rod is then struck by a hammer which forces the piercing point 36 into the wall 12 as shown in FIG. 5 thus initiating the hole. The continued forward movement of the hammer as well as subsequent blows of the hammer causes the hammer to then engage the free end 54 of the tube 32 thereby forcing the toothed edge 27 of the housing 14 into and through the wall 12 as shown in FIG. 6. Once the toothed edge 27 of the housing 14 passes completely through the wall 12 (FIG. 6) the hole is completed.

From the foregoing, it can be seen that the tool of the present invention provides a simple, inexpensive and yet totally effective means for forming square holes in masonry materials, such as cinder block walls.

Having described my invention, however, many modifications thereto will become apparent to those skilled in the art to which it pertains without deviation from the spirit of the invention as defined by the scope of the appended claims.

I claim:

1. A punch for forming an opening having a predetermined shape in a masonry wall comprising:

a housing, said housing having a wall with a toothed edge conforming in shape substantially to said predetermined shape, said toothed edge adapted to engage only one side of said masonry wall, a tube rigidly secured to said housing and extending perpendicularly outwardly from said toothed edge, said tube having an axis extending through an area circumscribed by said toothed edge, said tube having a free end spaced from said toothed edge, a rod slidably mounted in said tube, said rod having a piercing point at an end adjacent said toothed edge and within said housing, means for urging said piercing point toward said side of said masonry wall when said toothed edge is positioned against said side of said masonry wall, wherein said rod is dimensioned so that with said toothed edge and said point in engagement with only said side of said masonry wall, the other end of said rod protrudes outwardly from said free end of said tube, wherein said rod and said tube are dimensioned such that a free end of said rod protrudes outwardly from said free end of said tube by a preset distance such that, when the free end of said rod is struck by a hammer, said point initiates an opening only in said side of said masonry wall, and wherein, after said point initiates said opening, said hammer contacts said free end of said tube during said strike or upon subsequent strikes of the hammer so that the impact force of the hammer strike is imparted through the tube to the housing so that said housing is driven through said side of said masonry wall and forms said opening in said masonry wall.

2. The invention as defined in claim 1 wherein said toothed edge is rectangular in shape.

3. The invention as defined in claim 1 wherein said point is conical in shape.

4. The invention as defined in claim 1 wherein said urging means comprises a helical spring.

* * * * *